United States Patent [19]

Naster et al.

[11] Patent Number: 4,471,330

[45] Date of Patent: Sep. 11, 1984

[54] DIGITAL PHASE BIT FOR MICROWAVE OPERATION

[75] Inventors: Ronald J. Naster; John A. Windyka; Wendell M. Kong, all of Liverpool; Conrad E. Nelson, Camillus, all of N.Y.

[73] Assignee: General Electric Company, Syracuse, N.Y.

[21] Appl. No.: 438,028

[22] Filed: Nov. 1, 1982

[51] Int. Cl.[3] ..... H01P 1/18; H01P 1/185

[52] U.S. Cl. ..... 333/164; 333/161; 333/246

[58] Field of Search ..... 333/156, 157, 160, 161, 333/164, 245, 246; 307/241-243; 343/778

[56] References Cited

U.S. PATENT DOCUMENTS

| | | | |
|---|---|---|---|
| 3,491,314 | 1/1970 | White | 333/164 |
| 3,568,097 | 3/1971 | Hyltin | 333/161 |
| 4,056,792 | 11/1977 | Horwitz et al. | 333/156 |

*Primary Examiner*—Marvin L. Nussbaum
*Attorney, Agent, or Firm*—Richard V. Lang; Carl W. Baker

[57] ABSTRACT

A digital phase bit is provided for microwave operation, comprising a pair of FET switches and at least three transmission lines. The FETs when operated in a digital switching mode, present a small impedance when on and a high impedance when off. Each of two of the transmission lines exhibits a series inductive impedance over the operating frequency band and shunts a FET switch, two shunt combinations being interconnected by the third transmission line. When the switches are on, the signal path is effectively through the FET switch alone (and not branched) and a reference phase shift is produced. When the FET switches are off, a signal applied to the phase bit branches at each shunt combination. The inductive reactance of the transmission line and the capacitive reactance of the FET switch of each shunt combination then jointly produce a resonantly enhanced reactance over the band, causing a reflection and a maximum differential phase shift. The reflections are cancelled at the input port by a suitable choice of length and impedance for the third transmission line. The phase bit is suitable for monolithic fabrication on a common semiconductor substrate and is bidirectional when symmetrical FET switches are used.

6 Claims, 11 Drawing Figures

ON-STATE

ON-STATE
(REDUCED MODEL)

OFF-STATE

OFF-STATE
(REDUCED MODEL)

FIG. 4A SOS MESFET FOR ON-STATE
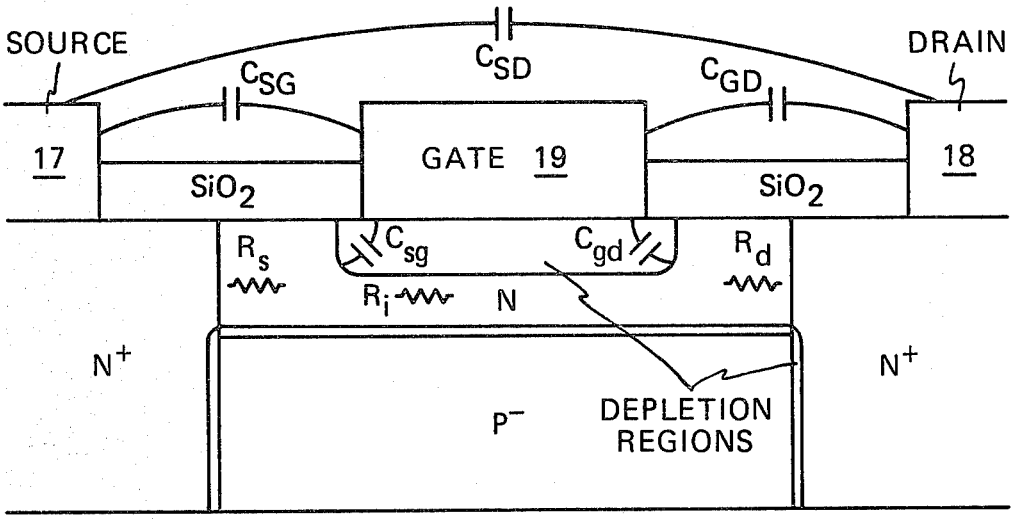
FIG. 4B SOS MESFET FOR OFF-STATE
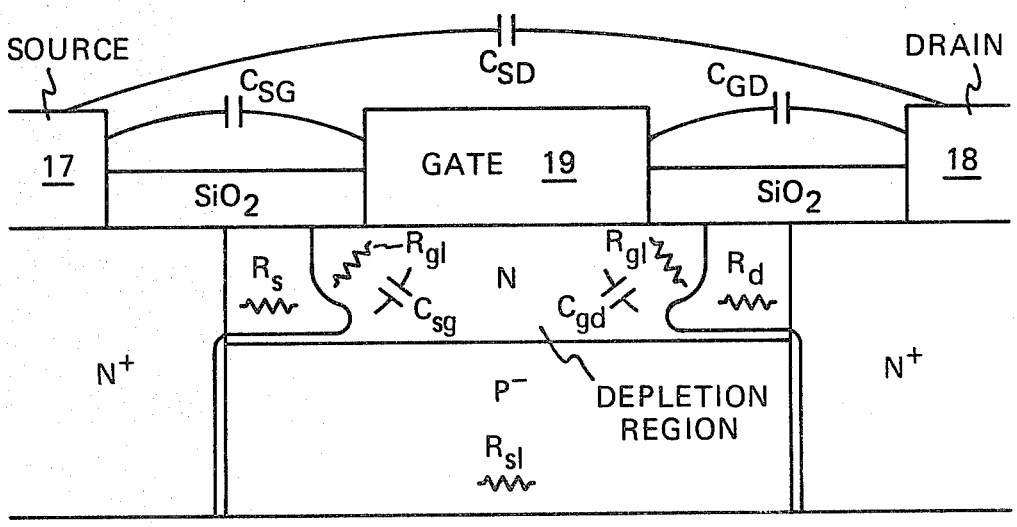

DIGITAL PHASE BIT FOR MICROWAVE OPERATION

This invention was made in the course of or under Contract No. F30602-79C-0159 awarded by the U.S. Air Force.

BACKGROUND OF THE INVENTION

1. Field of the Invention

The present invention relates to phase shifters for operation at microwave frequencies and more particularly to digital phase bits, which, as elements of a phase shifter, permit the attainment of a series of discrete phase shifts (e.g. 11.25°, 22.5° and 45°). The invention further relates to phase bits and phase shifters in which transmission line elements, reactive and resistive devices, and semiconductor switching elements are formed on a common monolithic substrate.

2. Description of the Prior Art

Digital phase bits have been built in solid state form for a number of years using PIN diodes as switching elements. These circuits have been commonly realized in a number of forms such as switched line, switched filter, quadrature hybrid and shunt loaded line designs. More recently SOS (silicon-on-sapphire) and GaAs (gallium arsenide) MESFETS (Metal (gate) Semiconductor Field Effect Transistors) have been used as switching elements in the fabrication of monolithic microwave phase shifter bits. GaAS MESFETs have been used to build switched filter phase shifters while similar devices have been used in switched line configurations. Shunt loaded line designs using MESFETs are also known.

The switched line and switched filter designs mentioned above are inherently lossy structures and the shunt loaded line devices may require good RF grounds which are difficult to achieve in monolithic form to provide proper performance.

A prior phase shifter is disclosed in U.S. application Ser. No. 327,133, filed 12/3/81, entitled "A Continuously Variable Phase Shifter" of R. J. Naster et al and assigned to the Assignee of the present application. In that application, a continuous phase shift is achieved by controlling the conductivity of a field effect transistor shunted with a transmission line.

SUMMARY OF THE INVENTION

Accordingly, it is an object of the present invention to provide an improved digital phase bit for microwave applications.

It is another object of the present invention to provide an improved digital phase bit for microwave application which may be fabricated on a semiconductor substrate.

It is a further object of the present invention to provide an improved series loaded line phase bit of monolithic design for microwave applications which is compact, has low insertion loss, low VSWR, is bidirectional, and is readily grounded for RF.

These and other objects of the invention are achieved in a novel digital phase bit operable over a selected band of microwave frequencies and suited to integrated fabrication. The phase bit comprises two field effect transistor switches, interconnected with five transmission lines. The first transmission line provides a first external connection to the first field effect transistor (FET) switch. A second and a third transmission line are provided, each exhibiting an inductive reactance over the band of operating frequencies. The second line and the first FET switch are connected in shunt to form a first shunt combination, and the third transmission line and the second FET switch are connected in shunt to form a second shunt combination. A fourth transmission line is provided interconnecting the first and the second shunt combinations, and having an electrical length and impedance selected to cause any reflection occurring at the first shunt combination and any reflection occurring at the second shunt combination to cancel in the first transmission line. A fifth transmission line is provided for a second external connection, to the second FET switch.

While recognizing that the phase bit is bidirectional, one may assume that the first external connection is to a source and that the second external connection is to a load. When the FET switches are on, waves are transmitted substantially undivided through the FET switches to effect a reference phase shift. When the FET switches are off, the waves divide at the shunt combinations to effect a second phase shift differing from the reference phase shift. Control means are provided associated with the gates of the two FET switches to cause them to assume a common off or common on state.

Preferably, each FET switch exhibits a high ratio of "off state" capacitive reactance to "on state" resistance over the band of operating frequencies. Consistently, the second and third transmission lines each exhibit a series inductive reactance, and the shunt combinations exhibit a resonant enhanced (preferably inductive) impedance over the band. The characteristic impedances of the transmission lines for external connection are preferably the same, with the on resistances of the FET switches being low in relation to these line impedances, to minimize insertion loss and reflections in the phase bit when the switches are on.

In accordance with another facet of the invention, the transmission lines and the FET switches are formed on a common monolithic semiconductor substrate, using unbalanced transmission lines. These lines are formed between defined conductors interconnecting the FET switches on one surface of the substrate and a continuous conductive layer on the other surface of the substrate. The FET switches are designed for bilateral operation, with the principal electrodes of the FET switches being maintained at the same dc potential and having gates which are symmetrically placed between said principal electrodes for equal conductance in either signal direction.

BRIEF DESCRIPTION OF THE DRAWINGS

The novel and distinctive features of the invention are set forth in the claims of the present application. The invention itself, however, together with further objects and advantages thereof, may best be understood by reference to the following description and accompanying drawings in which:

FIG. 2A is a complete equivalent circuit for "on" state operation, while FIG. 2B is a reduced equivalent circuit for "on" state operation; FIGS. 3A and 3B are respectively complete and reduced equivalent circuits for "off" state operation of said suitable MESFET switch;

FIG. 4A is a cross section of a suitable MESFET switch showing the interelemental capacitances, resistances and the depletion regions for "on" state operation; FIG. 4B is a cross section of the same MESFET showing the interelemental capacitances, resistances and the depletion regions for "off" state operation;

DESCRIPTION OF THE PREFERRED EMBODIMENT

Figure 1A:
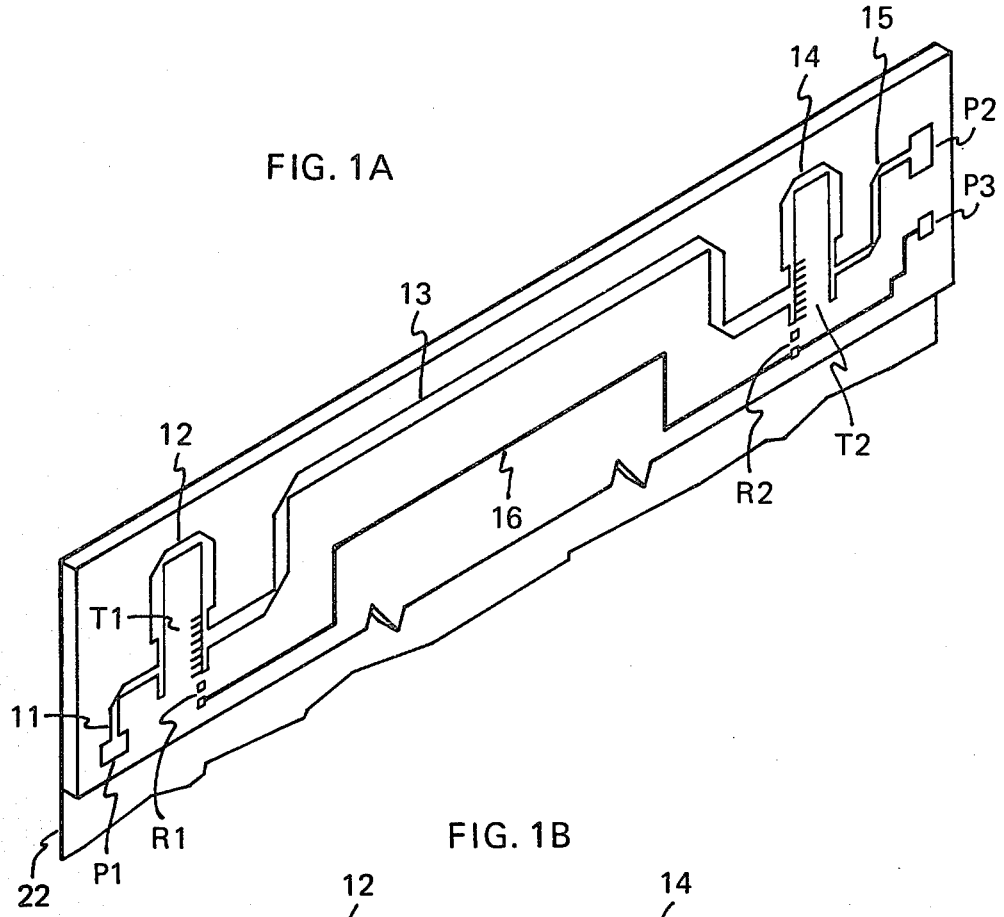
FIG. 1A is a perspective view of a novel phase bit incorporating the invention and suited to fabrication on a monolithic semiconductor substrate using microstrip transmission paths.
Figure 1B:
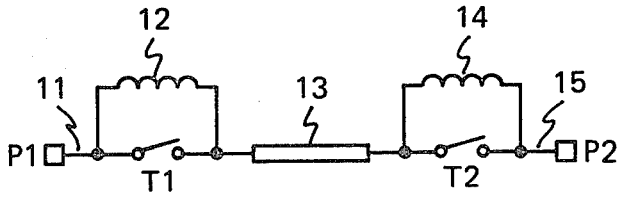
FIG. 1B is a simplified equivalent circuit representation of the phase bit.
Figure 1C:
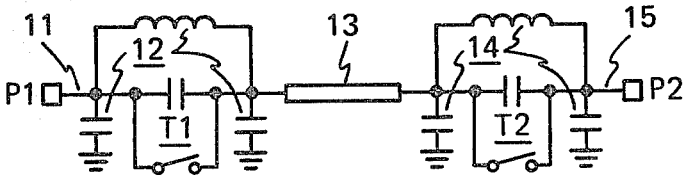
FIG. 1C is a less simplified equivalent circuit representation of the phase bit.

Referring now to FIGS. 1A, 1B and 1C, there is shown a novel phase bit for use in the gigahertz frequency range and suited to monolithic fabrication. In monolithic fabrication, high frequency transistors as well as inductors, capacitors and resistors are formed on the monolithic semiconductor substrate. High frequency transmission lines (11–15) are provided between circuit elements. These transmission lines are of the microstrip design in which conductors of defined width provided on the upper surface of the substrate act in conjunction with a continuous ground plane 22 provided on the under surface of the substrate to provide "unbalanced" microwave transmission paths.

The phase bit herein described is capable of producing a predetermined differential phase shift in accordance with the states of a digitally operated electrical control and in a manner suitable for beam forming applications. In this application, the differential phase shift occurs in predetermined increments, which are equal to 360° divided by a small integer power of two (e.g. $2^1$, $2^2$, $2^3$, $2^4$, $2^5$, etc.). In a typical case, a phase bit may produce a 11.25°, 22.5° or 45° phase shift between an "on" and an "off" state of the control. If larger amounts of phase shift are sought than can be provided by a single phase bit, pluralities of such phase bits are combined to achieve the desired total range of phase shift control and the necessary number of increments within the range. Typically, the phase bit is required to produce the specified phase shift with a given accuracy (e.g. 45°±2°) over a band of frequencies (e.g. 10% $f_o$). Other important criteria of the quality of performance of the phase bit include the insertion loss and the return loss or voltage standing wave ratio (VSWR). The designs herein described contemplate phase shifts over the frequency range of ½ GHz to tens of GHz, with bandwidths typically of 10% (but larger or smaller) and return loss usually in excess of 20 db. The insertion losses are typically about 1 db, but depend on overall switch characteristics.

As shown in FIG. 1A, the phase bit is inserted between the pads (P1 and P2) on the perimeter of the semiconductor substrate, with the pad P1 being connected via the microstrip line 11 to a first (T1) of two FETs operating as high frequency switches. Similarly, the pad P2 is connected via the microstrip line 15 to the second (T2) of the two FET switches. The phase bit also includes the two shunting microstrip lines (12 which shunts T1, 14 which shunts T2), the interconnecting microstrip line 13, and the control network. While the phase bit herein described is bidirectional due to the selection and biasing of T1 and T2, the rf input to the phase bit may be regarded for discussion purposes, as the pad P1 and the rf output from the phase bit, the pad P2. The microstrip line 13, which interconnects T1 and T2 has a specific electrical length and impedance, so designed that at the input pad P1 reflections caused by T1, 12 will be approximately equal to and approximately 180° out of phase with reflections caused by T2, 14. This requirement dictates that the line 13 have an electrical length near 90°, and a characteristic impedance near the system characteristic impedance (typically that of lines 11 and 15).

While a more detailed treatment of the transistors T1 and T2 will follow, the foregoing discussion assumes that the transistors T1 and T2 are FETs. Conduction occurs between the principal electrodes (also source or drain) of FET. The gate "controls" conduction. The principal electrodes are connected to the transmission lines. The shunting lines 12 and 14 in the embodiment provide both a microwave transmission path between principal electrodes and a dc connection which places both principal electrodes at the same dc potential. The dc potential of both principal electrodes is typically 0 volts with respect to ground. This mode of biasing is suitable for role reversal between input and output electrodes and for operating the devices as passive (no gain) on-off impedances. The gates of the FETs are connected via an rf isolating resistance R1 for T1 and R2 for T2 to the gate lead 16, which couples both gates to the external pad P3. In the practical application, the gate potential is set at zero volts to permit conduction and at the negative pinch-off voltage to prevent conduction.

FIG. 1B depicts the phase bit in a very simplified equivalent circuit representation. In FIG. 1B, the phase bit, which is connected between pads P1 and P2 by lines 11 and 15, is seen to consist of an rf switch T1 shunted by an inductance representing the microstrip transmission line 12, and a second rf switch T2 shunted by an inductance representing the microstrip transmission line 14, the two transistors being interconnected by the microstrip transmission line 13. In this simplified representation, it is assumed that the switch is a pure conductance having a negligibly low "on state" resistance and a high "off state" resistance.

As approximately represented in FIG. 1B, the phase bit provides a phase shift as the transistors T1 and T2 are switched on and off. Transistors T1 and T2 are simultaneously gated to "on" or "off" states. Thus, when T1 and T2 are "on", waves applied from P1 via 11 to T1, progress serially via T1, 13 and T2 to 15 and P2 without significant reflections back into the input pad P1. The T1, T2 "on" state provides the phase shift reference condition at output pad P2 of the phase bit.

When the switches T1 and T2 are "off, the microstrip 12, no longer short circuited by T1, introduces a net serial inductance of high impedance relative to line 11 into the transmission path to P2. This is a discontinuity causing a substantial reflection backward to P1 and causing a first increment in phase shift in the signal transmitted on to P2. Similarly, the microstrip 14, no longer short circuited by T2, introduces a net serial inductance in the path of P2. This second discontinuity causes a second substantial reflection backward toward pad P1 and causes a second increment in phase shift in the signal transmitted on to P2.

Prior to further elaboration of the FIG. 1B model it should be noted that any reflections occurring at T1, 12 and T2, 14 discontinuities may cancel at input pad P1 to reduce the VSWR at that point. Using an approximate analysis: the transmission path from P1 to T1, 12 and back to P1 should be made 180° shorter than the transmission path from P1 via T1, 12 via line 13 to T2, 14 and then back to P1 via line 13 and T1, 12. We will assume that T1, 12 and T2, 14 are "point" discontinuities. If these assumptions are true, the first reflection at P1 will be 180° out of phase from the second reflection at P1. If all transmission lines 11, 13, 15 have the same approximate characteristic impedances, and discontinuities, T1, 12 and T2, 14 have like inductive reactances and if the serial losses are relatively small, then to a first approximation, cancellation of the reflections will occur, and the desired low VSWR will result.

A more accurate, but still simplified equivalent circuit for the phase bit is shown in FIG. 1C. The transistor is modeled as an off capacitance and a switch, i.e., in the on state the transistor is approximately a short circuit. The shunting transmission lines, 12 and 14, are modeled as a pi network consisting of a series inductive reactance and two shunt (to ground) capacitive reactances. With the transistors in the "on" state (switch closed) the equivalent transmission line series inductance is shorted out and only the capacitive reactance to ground results. With the transistors in the "off" state (switch open) the equivalent transmission line series inductance is shunted by the transistor off capacitance. This parallel network is in series with the main transmission line 13 and its resonant frequency must be either above or below the desired operating frequency band to reduce the insertion loss. As discussed later, wider operating bandwidths result when operation is below resonance and the net reactance is inductive. Another salient feature of the design is that in the "on" state the shunt capacitance of transmission lines 12 and 14 cause reflections that must be matched out. This is accomplished by adjusting the impedance level of transmission line 13 as well as its length. With proper adjustment of this transmission line the VSWR of the phase bit will be low in both states.

A useful figure of merit for a transistor switch in high frequency applications is that there be a high ratio of capacitive reactance when the transistor is off (the off resistance paralleling the capacitance normally being very high, and neglectable) to the small resistance when the transistor is on. In addition, to minimize reflections when the transistor is on, and to obtain a low VSWR and a low insertion loss, the "on resistance" should be low relative to the characteristic impedance of the transmission lines into which it is connected. In a practical application of the invention at 2GHz, an off capacitive reactance of 100 ohms and an on resistance of 10 ohms is achievable for use of the FET in a transmission line system having a characteristic impedance of 80 ohms. Phase bits having return losses exceeding 20 db over 10% relative bandwidths have been constructed in these frequency ranges. As will be seen, the presence of capacitive coupling between the principal electrodes of T1 and T2 need not preclude good phase bit performance, since it may be usefully combined with the inductance of the shunt lines 12 and 14 to provide resonance enhanced impedances, suitable for achieving a desired magnitude of phase shift.

Figure 2A:
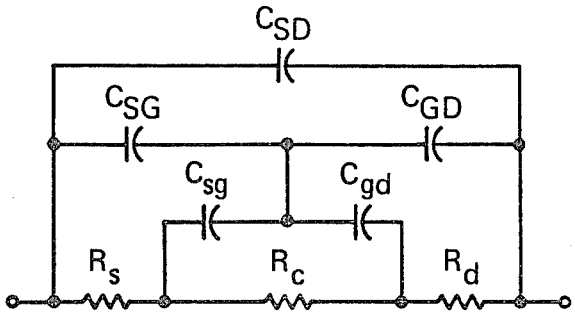
FIGS. 2A and 2B, and 3A and 3B are equivalent circuit representations of a MESFET suitable for use as the switching element in the phase bit.
Figure 2B:
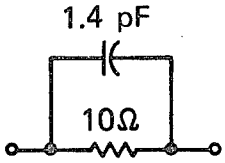

FIGS. 2A and 2B illustrate the "on state" equivalent circuit of a SOS MESFET suitable for operation in the 2GHz frequency range and applicable to the present application. The FET may have a 3500 micron gate width, for a 10% relative bandwidth. The first complex equivalent circuit illustrates the components of resistance and capacitance. In particular, the serial resistances comprise the source resistance ($R_s$), the channel resistance ($R_c$), and the drain resistance ($R_d$). The capacitive network includes the source to gate ($C_{sg}$) and gate to drain ($C_{gd}$) capacitances; the source to gate (CSG), the gate to drain (CGD) and the source to drain (CSD) capacitances. The reduced "on state" equivalent circuit comprises a 1.4 picofarad capacity ($C_{on}$) shunted by a 10 ohm resistance ($R_{on}$).

Figure 3A:
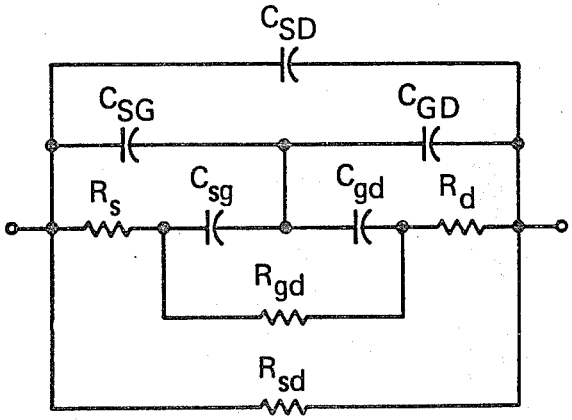
Figure 3B:
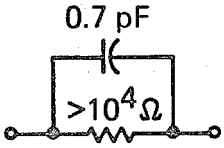

FIGS. 3A and 3B illustrate the "off state" equivalent circuit diagram of the same SOS MESFET. Here, the complex "off state" equivalent circuit of FIG. 3A is like that of the "on state" of FIG. 2A, except for an additional source to drain resistance $R_{sd}$ connecting input to output. The reduced equivalent circuit of FIG. 3B is in the same form as in FIG. 2B, but with differing values. For the same device, the capacity ($C_{off}$) is 0.7 pf and the resistance $R_{off}$ is $>10^4$ ohms.

FIGS. 4A and 4B illustrate on and off state equivalent circuits of a SOS MESFET using the symbols of FIGS. 2A, 2B, 3A and 3B and distributing them over a simplified cross section of a suitable MESFET semiconductor structure. The drawing additionally illustrates the operation of the FETs with zero applied drain to source bias voltage. The FET switches are designed to be normally on, depletion mode, with no gate bias. When FETs are designed for operation in this mode, they have no gain, but become switched (or variable) impedance elements, and the signal direction through the devices may be reversed.

In the illustrated SOS MESFET construction, the cross sections are of silicon supported upon a sapphire substrate (not shown). The silicon region is typically 1 micron in thickness while the sapphire substrate is normally 0.017". On the lowermost surface of sapphire is the continuous ground plane 22 required for the microstrip line. The ground plane consists of a 1000Å titanium layer and a 20,000Å gold layer.

The structure of the MESFET is modified for impedance switching, zero gain, bidirectional operation. The N+ degenerative diffusions to the right and to the left of the central channel region are both electroded on the top surface of the FET. These electrodes, illustrated in FIG. 4A, are elements of a larger interdigitated electrode structure and the "principal" electrodes of the FETs. While the leftmost electrode 17 is indicated to be the source and the rightmost electrode 18 to be the drain, the terms are interchangeable in the present application. The gate 19 is centrally placed over the n-type implanted channel between the source and drain for bidirectional operation. The gate is in contact with the N channel region to form a Schottky barrier gate. The gate electrode illustrated in FIG. 4 is an element of a larger interdigitated gate structure. (The term MESFET denotes that the gate electrode is metallic and in contact with a semiconductor channel region.) The small area directly underneath the gate electrode and lying within the n-type implanted silicon channel is a depletion region which naturally exists at the metal semiconductor face under a metallic gate electrode. It is a region depleted of carriers (electrons). The depletion mode operation is made more sensitive by the presence of a p-type silicon layer lying beneath n-type silicon. A second depletion region is shown where the P region abuts the surrounding source, gate and drain n-type implantations.

Switchable impedance, no gain, bidirectional FET operation occurs as follows. When the FET is conducting, electron carriers may flow via the channel region between source 17 and drain 18 (or the reverse), assuming zero source to drain bias, and that the gate is maintained at a zero bias. If a highly negative gate potential is applied, the depletion region immediately under the gate electrode is expanded downward across the channel to the P layer and "pinch off" occurs terminating conduction. Pinch-off implies that the region directly under the gate is depleted of carriers (electrons) forming a vertical barrier to lateral conduction through the channel. The P-implanted layer is provided to permit pinch-off at a lower gate voltage.

Figure 5:
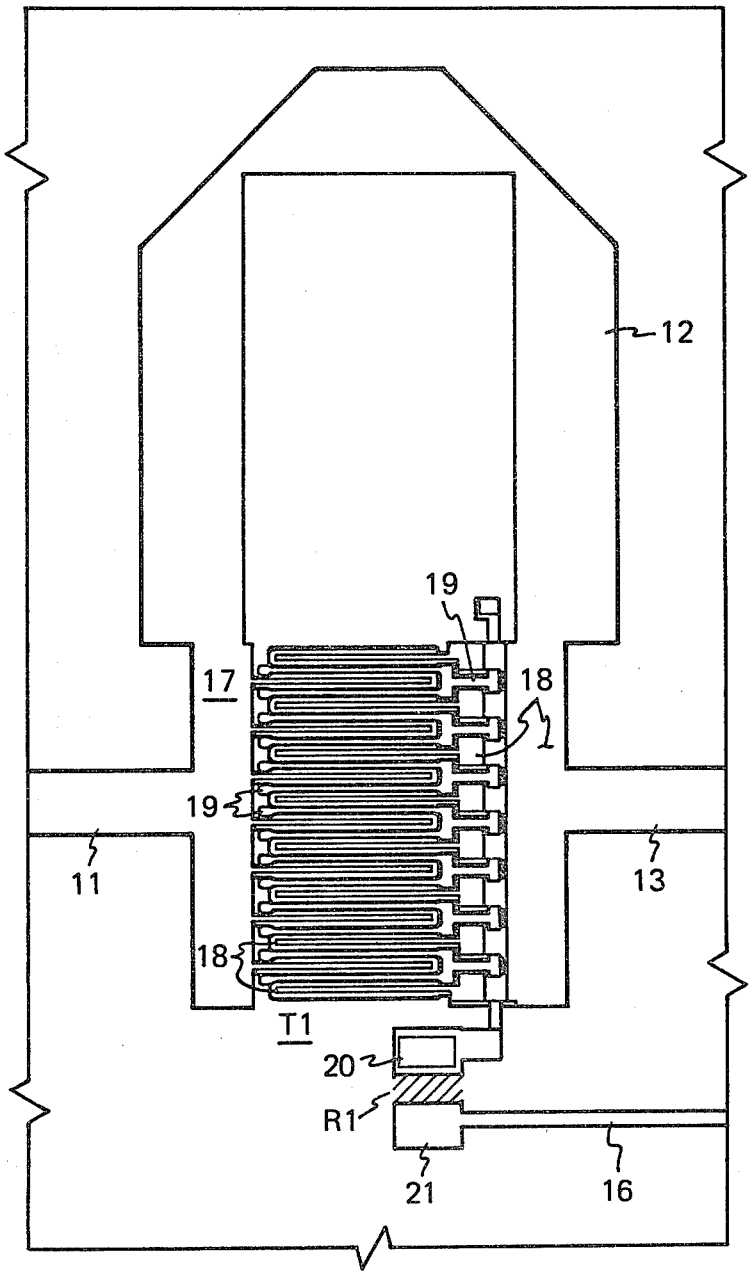
FIG. 5 is a plan view of a phase element including a MESFET and a shunting transmission path suitable for use in the phase bit illustrated in FIGS. 1A and 1B.

The arrangement illustrated in FIGS. 1A, 4A and 4B is illustrated in plan view in FIG. 5. The FIG. 5 drawing is of the device T1 and the shunting transmission line 12, together with the control connections to the gate. The vertical conductor to the left of the FET T1 and making contact to the transmission line 12 is a part of the source electrode, interconnecting the elements of the source electrode (shown in cross section in FIGS. 4A and 4B) to the transmission lines 11 and 12. Similarly, the interrupted vertical conductor to the right of the FET T1 and the vertical conductor to the right of it, making contact with the transmission line 12 are parts of the drain electrode, interconnecting the elements of the drain electrode 18 (whose cross sections are illustrated in FIGS. 4A and 4B) to the transmission lines 12 and 13. The interrupted vertical conductor interposed between the two vertical conductors of the drain electrode is a part of the gate electrode 19, the vertical conductor of the gate being connected to the control pad 20 and connected via a sequence of branched metallizations to the very fine digits (also illustrated in FIGS. 4A and 4B. The gate pad 20 is connected via an implanted resistor R1 to the pad 21 which is connected to the control line 16.

The dimensioning and design of the MESFET is for high frequency (>1GHz) operation in the bidirectional, switched impedance mode.

Assuming that an FET such as the one disclosed has been selected to operate in a passive, switched impedance mode and that it exhibits a useful figure of merit (a high ratio of capacitive reactance when off to resistance when on) and a low insertion loss (a low on resistance in relation to the characteristic impedance of the microstrip transmission line), one must suitably tune the arrangement to achieve a predetermined differential phase shift over a calculated bandwidth. The short line 12 shunting the FET T1 is made of a length suitable for creating a series inductive reactance over the operating band of frequencies, which in cooperation with the FET off capacitance, makes possible a resonance enhanced increase in impedance.

The design of the phase bit is complex due to the distributed nature of the shunting transmission lines 12 and 14, and the loss resistances in the FET switches T1 and T2. A simplified analysis, neglecting the equivalent transmission line shunt capacitive reactances and the FET resistances, provides an insight into the basic design principles. Referring to FIG. 1B, the inductors are considered to be switchable impedances, $Z_i$ or $jX_i$. The two states are on and off. In the present example, $Z_{on}$ is zero, i.e., $X_{on}=0$ and $Z_{off}=jX_{off}$. The simplified design equations in terms of the desired differential phase shift $\Delta\Psi$ are:

The desired differential phase shift ($\Delta\Psi$) is:

$$\Delta\Psi=\pm|\Delta\Psi| \tag{1}$$

The required switchable reactance ($X_{off}$) is:

$$X_{off}=\pm 2Z_o\tan|\Delta\Psi/2| \tag{2}$$

The required transmission line 13, characteristic impedance ($Z_{13}$) is:

$$Z_{13}=Z_0 \tag{3}$$

The required transmission line 13 electrical length ($\Theta_{13}$) is:

$$\Theta_{13}=\pi/2\pm|\Delta\Psi/2| \tag{4}$$

Note, $Z_0$ is the characteristic impedance of the system (e.g., 80 ohms). Therefore, if $X_{off}$ is negative (capacitive), then the differential phase shift is positive and $\Theta_{13}$ is greater than 90° by half the bit size. If $X_{off}$ is positive (inductive), then the differential phase shift is negative and $\Theta_{13}$ is less than 90° by half the bit size. In broad general terms, $Z_{off}$ determines the magnitude of the bit size and $\Theta_{13}$ is adjusted for an input impedance match, i.e., a low VSWR. When the series impedance is a parallel L and C as shown in FIG. 1C, the series off impedance is:

$$\begin{aligned} Z_{off} &= j\omega L/(1-\omega^2 LC) \\ &= j\omega L/(1-\omega^2/\omega_0^2) \end{aligned} \tag{5}$$

where L is the equivalent transmission line series inductance and C is the FET off capacitance. If the operating frequency is below the resonant frequency, the $Z_{off}$ is inductive.

Figure 6:
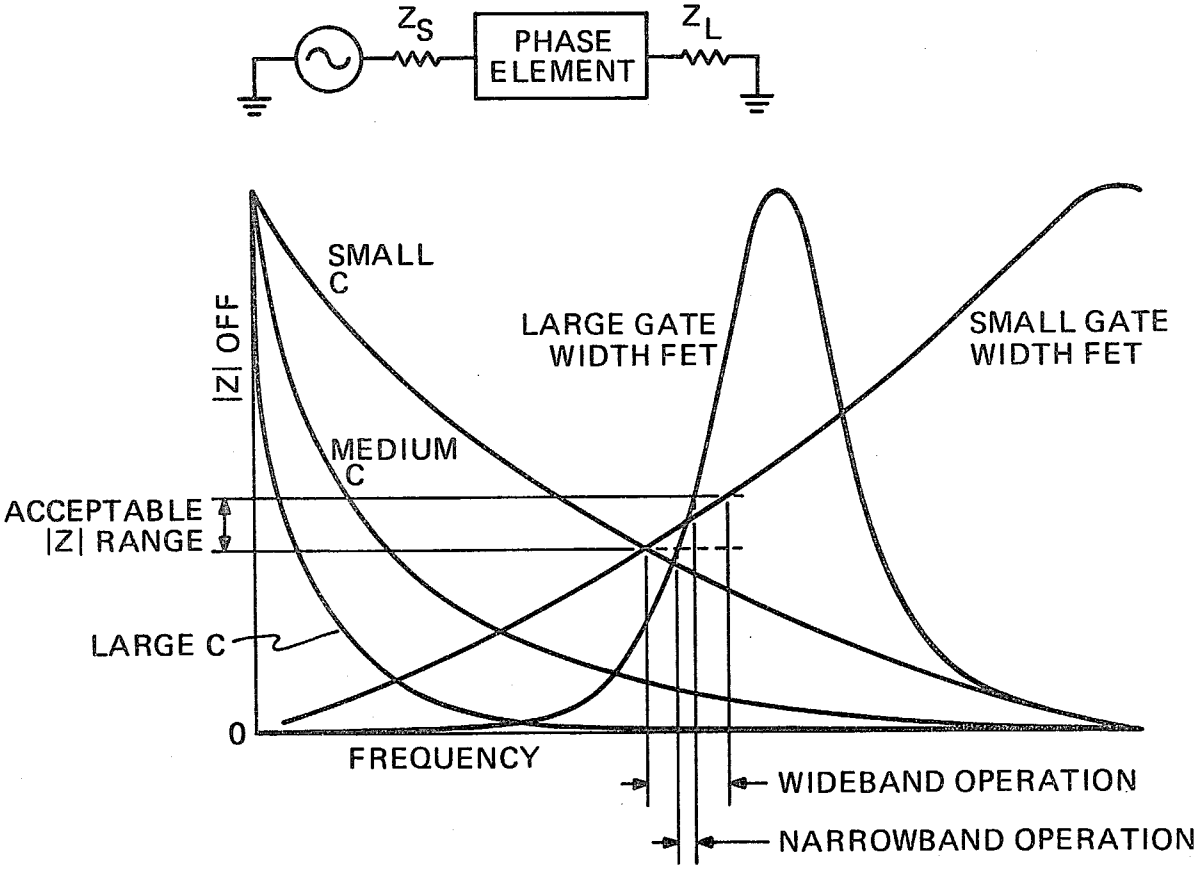
FIG. 6 is a family of curves explaining design optimizations of the phase element.

Issues in optimizing the design of the phase bit to a practical application are illustrated in FIG. 6. In FIG. 6, the off impedance $|Z|$ for a variety of impedances representative of one element of the phase bit are plotted against frequency. The equivalent circuit in which the phase element is placed is included in the illustration. An ac source is assumed having a source impedance $Z_S$. The source is coupled via the phase element to a load $Z_L$.

The design requires the element to provide a predetermined switched phase shift over a predetermined band of frequencies. In the zero or low phase shift mode there should be minimum reflections at the phase bit for a good VSWR. This generally dictates that the source impedance equal the load impedance. This requirement is met by making the characteristic impedances of the transmission lines into and out of the phase bit equal. The requirement of a low VSWR in the low phase shift (switch on) condition dictates that the phase bit present a low serial impedance relative to the characteristic impedance of the transmission line. This requirement is relaxed somewhat by the cancellation resulting from the present double element design.

The figure of merit applied to the switching device, earlier discussed, implies that the ratio of "off" reactance to "on" resistance should be high. Consistent with this requirement, one concludes that a resonant enhanced (LC) switched phase bit is preferable to a purely capacitive switched phase bit at the higher frequencies attainable by realizable devices.

In the event that one should wish to employ a purely capacitive switched phase element, which one would visualize as an FET having unavoidable through capacitance in both the "off" and "on" condition and high conductivity in the "on" condition, the plots of FIG. 6 are small, medium and large switched "Cs" are significant, relevant to design optimization. The "C" curves generally state that to obtain a given magnitude of impedance, which directly determines the amount of phase shift producible in the "off" condition of the switch, one needs a very small C. A large C will operate only at low frequencies, a medium C at somewhat higher frequencies, and the smallest attainable C at the highest attainable frequencies. With realizable FET devices, performance in the higher frequency spectrum, however, is limited by the ability to achieve a small enough C to achieve the desired large capacitive reactance $|Z|$. A second related problem is that to achieve a small C, the switching device must be small, and this (at high frequencies) increases the "on" resistance. An unduly high "on" resistance reduces the figure of merit of the switch. In practical terms, a lower figure of merit means that the impedance difference between "on" and "off" states will be smaller, and a smaller phase shift will be produced. It also means that the VSWR per element in the "on" condition will be worsened by the mismatch created by the low conductivity serial switch.

These considerations lead to using a resonant enhanced mode of operation, as taught in the present application, wherein a shunt inductance is provided around a specified FET. The use of a resonating inductance allows one to get higher reliable $|Z|$s, when one is operating at the higher frequency limits of a given FET (e.g. one having a specific "off" reactance due to interelectrode capacity). The two peaked curves of FIG. 6 are respectively one resonant curve with a large FET design having a sharp resonance peak, and a second curve shown to the left with a small FET design having a broad resonance peak. In both cases, it is assumed that a given $|Z|$ at a given frequency is sought. In the illustration, it is assumed that the $|Z|$ may be achieved by either resonantly enhanced design but is out of reach of a comparable pure C, phase element.

If the FET which will achieve the desired off $|Z|$ is selected to be at the larger end of the design range (i.e., the larger gate width), then the larger design will operate with lower losses, a higher "Q" and a more sharply peaked resonance. To operate on the skirt at a desired "Z", the slope of $|Z|$ versus frequency will be greater, and for a given tolerable phase error percentage, the bandwidth of operation will be smaller.

If a device is selected with a smaller geometry (gate width), then a greater bandwidth is achievable (at the same $|Z|$ and phase error). Thus, if bandwidth is the principal criterion, the smaller device is dictated. However, the "on" $|Z|$ condition still influences the design compromise. Smaller devices have worsened VSWRs due to the larger on state resistances. Due to the system design wherein the VSWR is substantially improved by using the out of phase reflections of two shunted switches to provide cancellation, smaller geometries may be tolerated.

The tuning of the phase element, as noted above, is such that the signal frequency is below the resonant frequency of the phase element so as to provide a net inductive reactance, including the capacitive reactance provided by the FET switch. Near resonance the phase shift for a transmitted wave goes through a sudden reversal reaching a near maximum value as the resonant frequency is approached, falling rapidly to zero at resonance and just above resonance reaching a near maximum value of opposite sense. This nonlinearity in phase with frequency dictates that one operate well away from the peak resonance region. The design feature by which two phase elements are linked together so that their reflections cancel, forces the design to be optimized with both elements operated on the same side of the resonance curve and at approximately like positions along the slope. Operating below resonance (inductive) is the preferred mode for wide bandwidths.

In the design, the characteristic impedance of the input and output transmission lines have the same value (approximately 80 ohms). The transmission line interconnecting the phase elements may have the same value as the input and output lines but the designer has freedom to design around this value. The shunting lines are designed to an impedance and length such that the desired inductive contribution is achieved over the frequency band of interest. In general, the characteristic impedance of the shunting transmission lines 12 and 14 should be high to minimize their lengths and reduce the equivalent shunt capacitances to ground. However, if the impedances are made too large (e.g., over 100 ohms), then the transmission line conductor losses increase and the phase shifter insertion loss increases.

The more complete equivalent circuit, shown in FIG. 1C, with the equivalent transmission line shunt capacitors can be matched in both states by adjusting the impedance as well as the length of the connecting transmission line 13. However, in the practical case, including the FET loss resistances, the transmission line impedance and length must be further adjusted to minimize the input VSWRs in both states.

The phase bits herein described can be used at frequencies from approximately 1 to 20 GHz, depending upon the tolerable size of the substrate which establishes the lower frequency operating limit and high frequency performance of the FET switch, which establishes the higher frequency operating limit. The materials which have been found to have good operating characteristics at high frequencies have been silicon-on-sapphire and gallium arsenide. The GaAs MESFET design (with a metal contact to the gate region) appears to have the best high frequency properties of current devices. For instance, using a 1 micron gate length, the theoretical cut-off frequency for switching mode operation is between 200 and 300GHz. Practical ranges are smaller. Comparable cut-off frequencies are 50GHz for a SOS MOSFET (metal-oxide, etc.) design and 25GHz for a SOS (MESFET) design. The preferred embodiment is a bidirectional depletion mode FET, not exhibiting gain. The bidirectional feature permits the phase bit to be inserted into the path to an antenna array, in which the transmitted and received signals propagate in opposite directions.

The resulting phase bit is small in size due to the short lengths of the transmission lines. The two shunting transmission lines provide two major benefits. The first is that the two major FET electrodes (i.e., source and drain) are maintained at the same dc potential. This greatly simplifies the dc bias circuit. The second advantage of these transmission lines, when operating on the low side of resonance (inductive) is that the FET off capacitance now has only a second order effect on the net off impedance, i.e., the differential phase shift errors due to manufacturing tolerances on the FET capacitances will be lower. The manufacturing process results in accurate microstrip transmission line conductor widths and therefore accurate characteristic impedances. These accurate transmission lines provide accurate off impedances and hence accurate differential phase shifts. The monolithic fabrication results in a phase bit entirely on a single substrate without the need for wire bonds connecting the transistors to the transmission lines. The bottom surface of the substrate is ground, which simplifies the circuit mounting.

What is claimed is:

1. A digital phase bit operable over a selected band of frequencies and suited to integrated fabrications, comprising:

A. a first transmission line for external connection;

B. a first and a second field effect transistor (FET) switch, each having two principal electrodes and a gate for control of conduction between said principal electrodes, said FET switches exhibiting a high ratio of off to on impedance over said band, a first principal electrode of said first FET switch being connected to said first transmission line;

C. a second and a third transmission line, each exhibiting an inductive reactance over said band, said second transmission line and said first FET switch being connected in shunt to form a first shunt combination, and said third transmission line and said second FET switch being connected in shunt to form a second shunt combination;

D. a fourth transmission line connecting the second principal electrode of said first FET switch to a first principal electrode of said second FET switch, and having an electrical length and impedance selected to cause the reflection occurring at said second shunt combination and the reflection occurring at said first shunt combination to cancel in said first transmission line;

E. a fifth transmission line for external connection, connected to the second principal electrode of said second FET switch, the waves transmitted through said phase bit being transmitted, when said FET switches are on, substantially undivided through said FET switches to effect a reference phase shift; and when said FET switches are off, dividing at said shunt combinations to effect a second phase shift, differing from the reference phase shift; and F. control means associated with said gates to cause said FET switches to assume a common off or common on state.

2. A digital phase bit as set forth in claim 1 wherein said FET switches exhibit a high ratio of capacitive reactance, when off, to resistance, when on, over said band.

3. A digital phase bit as set forth in claim 2 wherein said second and third transmission lines each exhibit a series inductive reactance and said first and second FET switches, when off, each exhibit a capacitive reactance over said band, said shunt combinations exhibiting a resonant enhanced impedance over said band.

4. A digital phase bit as set forth in claim 3 wherein the characteristic impedances of said input and output transmission lines are approximately the same, and wherein the on state resistances of said FET switches are low in relation to said transmission line impedances to minimize reflections and insertion loss when said switches are on.

5. A digital phase bit as set forth in claim 4 wherein said transmission lines and said FET switches are formed on a common monolithic semiconductor substrate, said transmission lines being unbalanced, being formed between defined conductors interconnecting said FET switches on one surface of the substrate and a continuous conductive layer on the other surface of said substrate.

6. A digital phase bit as set forth in claim 5 wherein said FET switches are designed for bilateral operation, the principal electrodes of said FET switches being maintained at the same dc potential, and the gate being symmetrically placed between said principal electrodes for equal conductance operation in either signal direction.

* * * * *